US005890916A

United States Patent [19]

Diekmann et al.

[11] Patent Number: 5,890,916

[45] Date of Patent: Apr. 6, 1999

[54] CONNECTOR MEANS FOR CONNECTING A CONDUCTOR TO A GROUND RAIL

[75] Inventors: Jörg Diekmann, Oerlinghausen; Rainer Schulze, Detmold; Walter Hanning, Detmold; Manfred Wilmes, Detmold; Bernhard Schuster, Detmold, all of Germany

[73] Assignee: Weidmuller Interface GmbH & Co.

[21] Appl. No.: 903,764

[22] Filed: Jul. 31, 1997

[30] Foreign Application Priority Data

Aug. 3, 1996 [DE] Germany ..... 196 31 436.4

[51] Int. Cl.[6] ..... H01R 4/66

[52] U.S. Cl. ..... 439/94

[58] Field of Search ..... 439/716, 532, 439/94

[56] References Cited

U.S. PATENT DOCUMENTS 5,022,873 6/1991 Kollmann ..... 439/716
5,362,259 11/1994 Bolliger ..... 439/716

FOREIGN PATENT DOCUMENTS

0556560A1 8/1993 European Pat. Off. .
39 03752 8/1980 Germany .

*Primary Examiner*—Gary F. Paumen
*Attorney, Agent, or Firm*—Laubscher & Laubscher

[57] ABSTRACT

A connector assembly is operable to connect a conductor with a generally U-shaped ground rail having a pair of upwardly extending legs that terminate in outwardly directed flange portions, including a conductive plate having a body panel that extends transversely above the rail. At a first end, the body panel included a downwardly extending hook portion the extends in locking relation beneath the flange portion of the associated first rail; at its other end, a first plate support panel is connected with the bottom of the body pane for bending movement about a first generally horizontal fold lined to a support position generally normal to the body panel and in engagement with the upper surface of the flange portion of the other rail. The plate is connected with the other rail leg by an inverted generally U-shaped spring member having a base portion that extends parallel with the body panel above the first support panel, and a pair of leg portions having end extremities that extend beneath the associated edge of the first plate support panel and the adjacent rail flange portion, respectively.

8 Claims, 1 Drawing Sheet

CONNECTOR MEANS FOR CONNECTING A CONDUCTOR TO A GROUND RAIL

BACKGROUND OF THE INVENTION

1. Field of the Invention

Connector means are provided for connecting a conductor, an electrical terminal block or the like with an inverted generally U-shaped ground rail having a pair of upwardly extending legs that terminate in outwardly extending flange portions, including a conductive plate having a body panel that extends transversely above the ground rail and includes at one end a hook portion that is locked beneath the flange portion of a first leg of the ground rail, and at the other end a plate support panel that is bent outwardly from the bottom edge portion of the body panel to a position generally normal to the body panel and in supported engagement with the upper surface a second rail leg. An inverted generally U-shaped spring has a base portion that extends parallel with the body panel above the plate support, and leg portions that are bent inwardly under the support panel and under the flange of the associated leg of the ground rail, respectively, thereby to mount the plate on the ground rail.

2. Brief Description of the Prior Art

It well known in the patented prior art to provide connector devices for connecting electrical conductors, terminal blocks and the like with a grounded rail conductor. As shown by the German Patent No. DE 39 03 752 C2, and the European Patent No. EP 0 556 560 B1, fastening feet on the connector generate sufficient retaining force for retaining the connector on a mounting rail (such as the ground rail of an electrical panel box) to effect good electrical contact while at the same time affording the necessary mechanical stability. On the basis of these designs, one is no longer dependent on the provision of additional catch feet on the insulated housings of the terminal blocks, but one does require a large volume and therefore extensive resilient force for clamping the connector to the grounded mounting rail.

On the other hand, a grounded conductor connection has been disclosed in the European patent No. EP 0 444 656 B1 wherein the contact and the fastening foot are provided with at least one hook segment that grasps one of the mounting rail legs, and where the contact and fastening foot has segments that also sit on the mounting rail legs, the spring being supported to mechanically retain the components together to effect the desired electrical contact force upon the mounting rail legs or on an abutment formed on the contact in the fastening foot. In this case, the resilient spring can no longer engage both mounting rail legs, and therefore the spring can be made relatively short and powerful. Thus, one can basically also select the spring characteristics and size in order to achieve good electrical connection with the conductive mounting rail, which may be formed of copper. However, the known design includes inherent problems, such as providing the connection between the connector in the fastening foot in the spring, which spring contains a slit up to its terminal areas and the contact and fastening foot has perpendicular segments and several abutments such that, for the purpose of final assembly, areas of the contact and fastening foot must be inserted through the slit of the spring on the latter supported against the abutments. The spring thus contacts one mounting rail leg from above when in the position ready for use along with a deformation and generation of the spring force. Making such a spring with a slit is complicated, and the slit also weakens the spring. In this design, the contact and fastening foot has a complicated three-dimensional shape. It is difficult to connect the spring with the contact and fastening foot during assembly.

The present invention was developed to avoid the above and other drawbacks of the known connecting devices.

SUMMARY OF THE INVENTION

Accordingly, a primary object of the present invention is to provide an improved inexpensive ground connector that is formed from conductive plate stock and includes a body panel that extends transversely above and normal to a conventional generally U-shaped ground rail having a pair of upwardly extending legs that terminate in outwardly directed flange portions, said plate body panel having at one end a hook portion that extends downwardly in locking engagement beneath one flange portion of a first leg portion of the ground rail, and a first plate support panel extending normal to the bottom portion of the other end of the body panel in supported engagement with the upper surface of the other leg portion of the ground rail, inverted U-shaped spring means being operable to connect the first support panel with the adjacent rail leg, thereby to mount the connector plate on the ground rail.

According to a more specific object of the invention, the first support panel is connected with the body panel by a fold line that is arranged at an acute angle with the horizontal, the spring being connected between the top edge of the first support panel and the associated rail flange. The lower tip portion of the first support panel may be bent downwardly for pointed engagement with the ground rail. A spring mounting panel is connected with the body panel by a generally vertical fold line and extends at right angles to the body panel to a support position in which it supports the base portion of the inverted U-shaped spring.

According to a further object, the body panel is provided at the lower portion of its first end with orthogonally bent second plate support panel that engages the upper surface of the first leg of the ground rail.

BRIEF DESCRIPTION OF THE DRAWINGS

Other objects and advantages of the invention will become apparent from a study of the following specification when viewed in the light of the accompanying drawings, in which.

DETAILED DESCRIPTION

Figure 1:
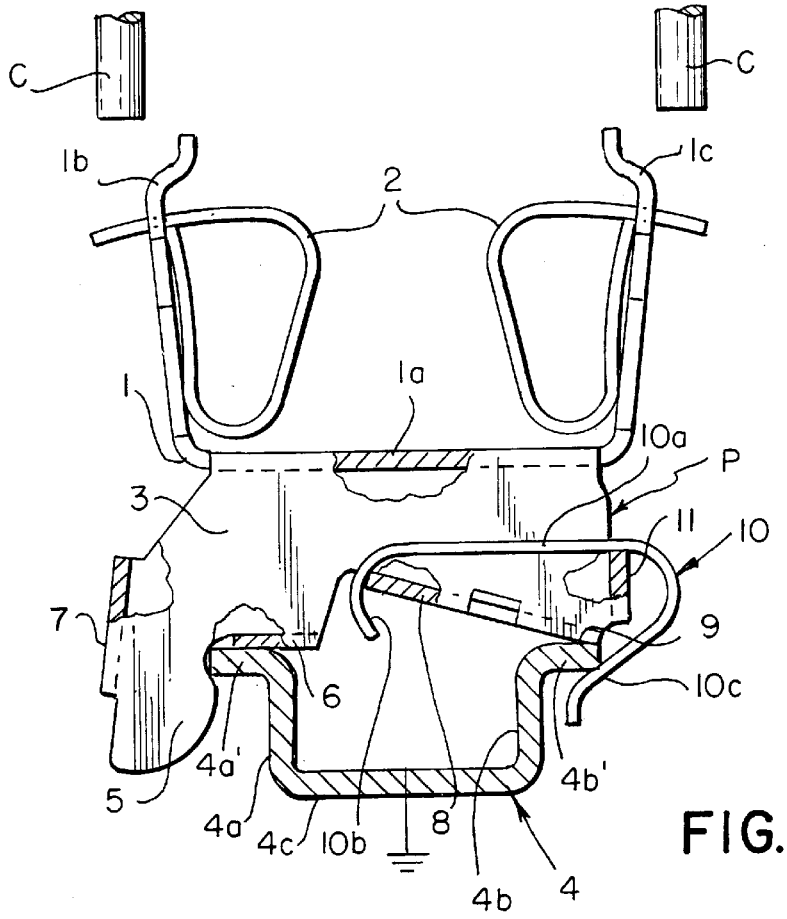
FIG. 1 is partly sectioned elevation view of the ground connector assembly of the present invention mounted on a ground rail.

Referring first more particularly to FIG. 1, the connector means of the present invention includes a conductive plate member P for electrically connecting a pair of conductors C and C' with a grounded mounting rail 4 that is fastened to an electrical panel or the like (not shown). The ground rail 4 includes a generally horizontal base portion 4*c* and a pair of upwardly extending leg portions 4*a* and 4*b* that terminate in outwardly extending flange portions 4*a*' and 4*b*', respectively.

Figure 2:
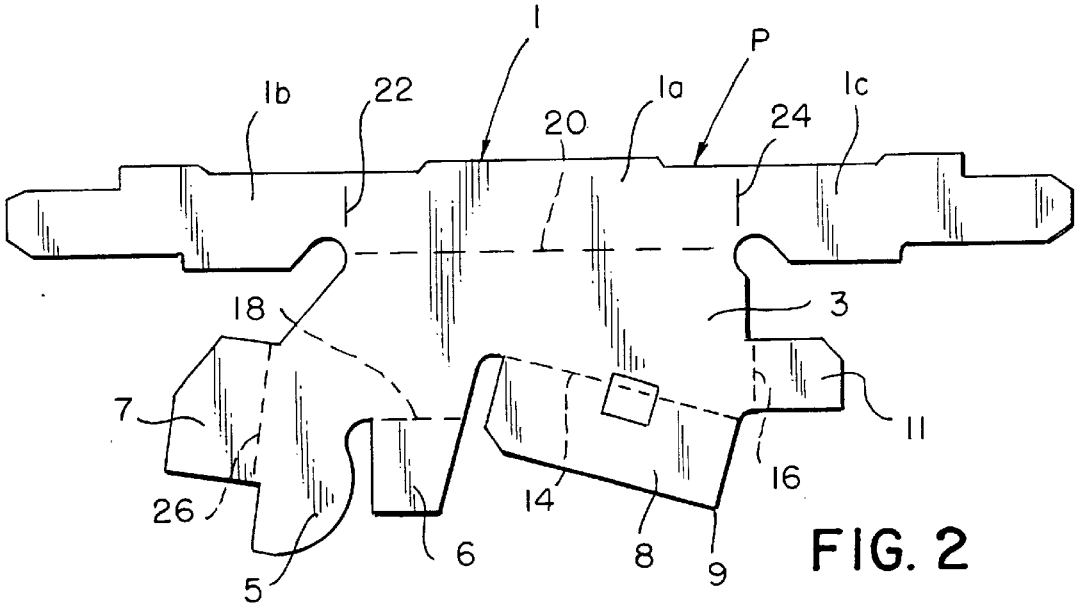
FIG. 2 is a plan view of the conductive metal blank from which the conductive plate is formed.

Referring to FIG. 2, the connecting plate P is formed from metal stock of a suitable electrically conductive metal material, and includes a generally rectangular body portion 3 having at one end an integral downwardly extending hook portion 5. A first plate support panel 8 is connected with the lower portion of the other end of the body panel 3 by a fold line 14 that is ranged at an acute angle relative to the horizontal, and at the first end, the plate is provided with the second plate support panel 6 that is connected with the lower portion of the panel 3 by fold line 18. At its left hand end, the connector panel 3 is provided with a release panel 7 that is connected with the panel 3 by a fold line 26, and at its right hand end, the plate is provided with a spring support panel 11 that is connected with the panel 3 by a vertical fold line 16. At its top, the plate is provided with a connecting panel 1*a* by a line of bending 20, the panel 1*a* having at each end end flaps 1*b* and 1*c* that are bent upwardly to the vertical position about lines of bending 22 and 24 when the base panel 1*a* is bent around fold line 20 to a position normal to the connector plate 3.

Assuming that the panels 7, 6, 8, 11, and 1 are bent to positions normal to that of the connector body panel 3, the hook portion 5 is inserted beneath the outwardly extending flange 4*a*', and the right hand end of the support panel 8 is seated on the upper surface of the adjacent flange portion 4*b* reference numeral prime of the grounded U-shaped rail. The mounting spring 10 has an inverted U-shaped construction with a horizontal base portion 10*a* and a pair of downwardly extending leg portions 10*b* and 10*c* of unequal length. The shorter leg portion 10*b* is hooked beneath the left hand edge of the plate support panel 8, and the intermediate base portion of the spring 10*a* is seated on the upper surface of the spring support panel 11, as shown in FIG. 1. The longer spring leg 10*c* extends downwardly and inwardly beneath the outwardly directed flange portion 4*b*' of the grounded mounting rail 4.

Thus, the resilient force of the spring 10 maintains the right hand end portion of the connector body 3 with the upper surface of the rail leg 4*b*, the other side of the connector body 3 being hooked by hook means 5 beneath the outwardly directed flange 4*a* of the ground rail 4.

The spring clip terminals 2 are connected with the upward extending connecting portions 1*b* and 1*c* in a known manner, such that when the movable portions of the terminals are displaced apart, the conductor C and C' can be displaced axially downwardly within corresponding openings contained in the moveable arm portions of the resilient terminals, thereby to effect connection with ground.

In order to remove the connecting plate P from the rail 4, a suitable tool (such as a screw driver) is placed beneath the release tab 7 for engagement with the adjacent rail flange 4*a*', whereby upward leverage of the tool about the rail flange 4*a*' produces pivotal lifting of the associated end of the connector means, upwardly relative to the ground rail 4.

As indicated above, the fold line 14 for the first plate support panel 8 is arranged at an acute angle relative to the horizontal, whereby the lower edge of the plate member 8 is provided with a sharp tip portion 9 that may be bent downwardly toward engagement with the upper surface of the associated flange portion 4*b*' as shown in FIG. 1, thereby to improve the electrical contact between the components. It is apparent from the above description that the blank from which the connector is formed can be made in a simple manner by appropriate stamping or cutting together with bending of the associated tabs about their respective lines of bending to positions normal to the plane containing the body panel 3. Good conductivity between the plate and body portion 3 and the ground rail 4 is achieved owing to the inherent spring strength of the spring member 10, and the penetration of the tip 9.

Thus, it should be emphasized that according to the basic structural principle of the present invention, spring 10 cooperates with only one mounting rail leg 4, whereby on the structural principal of a bus bar connection, it can be made flexible in a versatile fashion, since when it comes to a configuration of the hook segment area, one is free to adapt to the conditions of the particular mounting rail. For example, if a mounting rail is considerably wider than the one that is shown, even if the configuration of the mounting rail where to deviate at one of its ends, the contact and fastening foot could then be accordingly redesigned in the corresponding area.

While in accordance with the provisions of the Patent Statute, the preferred forms and embodiments of the invention have been illustrated and described, it will be apparent to those skilled in the art that various changes may be made without deviating from the inventive concepts set forth above.

What is claimed is:

1. Connector means for connecting a conductor with a generally U-shaped ground rail having a horizontal base portion (4*c*) and a pair of upwardly extending leg portions (4*a*, 4*b*) terminating in outwardly extending flange portions (4*a*', 4*b*'), comprising:

(a) a conductive plate (P) including:

(1) a body panel (3) provided at one end with a downwardly extending hook portion (5) adapted to extend below one of the rail flange portions when said body panel is arranged normal to and transversely across the upper surface of the ground rail;

(2) a first plate support panel (8) connected with a power portion of the other end of said body panel by a generally horizontal first fold line (14), said first support panel being folded about said first fold line to a position normal to said body panel for supporting engagement with the upper surface of the other rail flange portion; and (3) connecting panel means (1) connected with the upper portion of said body panel for connecting said plate with the conductor; and (b) means for connecting said other end of said body panel with said other rail flange portion, including a resilient inverted generally U-shaped spring member (10) having a generally horizontal base portion (10*a*) extending parallel with said body panel above said first support panel, said spring member including a pair of downwardly extending generally inwardly bent leg portions (10*b*, 10*c*) that extend below adjacent edges of said support panel and said other rail flange portion, respectively.

2. Connector means as defined in claim 1, wherein said first fold line (14) extends upwardly at an acute angle relative to the horizontal.

3. Connector means as defined in claim 2, wherein said plate further includes at said other end of said body panel a spring member mounting panel (11) connected with said body panel by a vertical second fold line (16), said spring mounting panel being folded about said second fold line to a position generally normal to said body panel in supporting relation relative to said spring member base portion.

4. Connector means as defined in claim 2, wherein said support panel includes a lower tip portion (9) that is downwardly bent toward engagement with the upper surface of said other rail flange portion.

5. Connector means as defined in claim 1, and further including:

(d) a second plate support panel (6) connected with the lower end of said body panel one end by a generally horizontal third fold line (18), said second plate support panel being bent about said third fold line to a position normal to said body panel for supporting engagement with the upper surface of said one rail flange portion.

6. Connector means as defined in claim 1, wherein said connecting panel means includes a connecting panel (1*a*) connected with the top edge of said body panel by a generally horizontal fourth fold line (20), said connecting panel being bent around said fourth fold line to a position normal to said body panel, said connecting panel including at each end a pair of end flaps (1*b*, 1*c*) that are foldable upwardly about fifth and sixth fold lines (22,24) to connecting positions normal to said connecting panel.

7. Connecting means as defined in claim 6, and further including resilient terminal means (2) for connecting each of said connecting flaps with electrical conductors, respectively.

8. Connecting means as defined in claim 7, and further including a release panel (7) connected with said first end of said body panel by a generally vertical seventh fold line (26), said release panel being folded about said seventh fold line to a release position normal to said body panel, wherein a tool may be inserted beneath the lower edge of said release panel for cooperation with said one rail flange portion to lift said plate from the rail.

* * * * *